US005659143A

United States Patent [19]

Isackson

[11] Patent Number: 5,659,143

[45] Date of Patent: Aug. 19, 1997

[54] HAND-HELD PERCUSSIVE SHAKER INSTRUMENT

[76] Inventor: Nadene S. Isackson, 17 S. River St., Suite 201, Janesville, Wis. 53547-8223

[21] Appl. No.: 509,771

[22] Filed: Aug. 1, 1995

[51] Int. Cl.[6] ..... G10D 13/08

[52] U.S. Cl. ..... 84/402; 446/419

[58] Field of Search ..... 84/402, 403, 404; 446/418, 419

[56] References Cited

U.S. PATENT DOCUMENTS

| | | | |
|---|---|---|---|
| 4,165,671 | 8/1979 | De Bose | 84/402 |
| 4,179,973 | 12/1979 | White | 84/402 |
| 4,901,617 | 2/1990 | Malone et al. | 84/402 |
| 4,968,283 | 11/1990 | Montgomery | 446/419 |
| 5,377,575 | 1/1995 | Huth, III | 84/402 |

*Primary Examiner*—Cassandra C. Spyrou
*Attorney, Agent, or Firm*—Amster, Rothstein & Ebenstein

[57] ABSTRACT

A hand-held percussive musical shaker comprising an elongated tubular member defining a hollow bore therethrough and having a pair of plastic diaphragms sealed over the respective ends of the tubular member to collectively form an enclosed containment volume, the containment volume being loosely filled with a percussive media such as a plurality of metallic particles, the containment volume having an optimized major length to minor diameter ratio.

1 Claim, 1 Drawing Sheet

HAND-HELD PERCUSSIVE SHAKER INSTRUMENT

BACKGROUND

The present invention relates generally to musical instruments, and more particularly, to a percussive shaker instrument. A typical musical shaker is comprised of a hollow container having a number of relatively small percussive media such as metal shot, plastic beads, or even seeds or small stones disposed therein. The most noteworthy of these is the Maraca which, in its original form, was simply a dried gourd filled inside with seeds and a handle attached to one end of the gourd. This instrument was made popular in the 1930's and 1940's by Havana-based bands who used them extensively for their driving Latin rhythms. In its more modern iteration, the Maraca is typically fabricated from a plastic material, albeit still in the traditional gourd shape. There are also many other types of shakers which are presently available in the art and widely used in various musical venues.

The manner in which a shaker instrument is used is simple and well-known. The instrument is played by moving it rapidly from one spatial position to another. The percussive media (beads, shot, etc.) occupy a relatively small proportion of the internal volume of the instrument and alternatively travel between the internal walls of the container. Sounds are produced when the media impacts the container walls and itself, thereby generating vibrations sympathetic to the container's size, shape and material. When this action is repeated in the hands of a skilled player, the sound produced becomes rhythmic and adds excitement and dimension to the ambient music. Most shakers produce percussive effects which fall within the upper half of the audio spectrum, from about 6000 Hz and up. In a high fidelity system, the sounds generated by the shaker are reproduced primarily by the tweeter, with some of the more pronounced musical attacks being found in the mid-range transducer.

Trial and error experimentation demonstrates that in the optimum configuration, the percussive media should travel a distance of between approximately three (3) to five (5) inches between striking the opposite walls of the longitudinal extent of the container. This dimension reflects a balance between playability and the desired volume of sound to be produced. The greater the distance the media must travel, the longer the amount of time it is able to accelerate, and the consequent inertial increase produces a greater martial crash of the media and thus a higher sound volume. Too long a travel distance, however, results in a two-fold disadvantage. A relatively large distance limits the player's ability to rapidly reverse the direction of travel and prevents rapid repeat movements, which in turn limits musical expression. A more subtle disadvantage is most apparent when several players attempt to play in unison. When the media becomes airborne during the travel time, it prevents the player from obtaining perceptible feedback through the instrument as to the location of the media vis-a-vis the walls of the container. Several popular prior art shakers are constructed from tubing in the neighborhood of four (4) inches in diameter and approximately ten (10) inches in length. Because of this relatively large travel distance, and as these are primarily played from side to side, they do not have good control characteristics and therefore require increased player skill to properly manipulate. These disadvantages are directly addressed by and are overcome in the shaker disclosed and claimed herein in accordance with the present invention.

SUMMARY OF THE INVENTION

In accordance with the present invention, it is an object thereof to provide a hand-held percussive shaker instrument having optimized sizing to provide superior percussive effects.

It is a further object of the present invention to provide a hand-held percussive shaker instrument having a configuration which provides the user with sufficient feedback for better control and manipulation.

It is yet another object of the present invention to provide a hand-held percussive shaker instrument in which the percussive media has a relatively high density to facilitate superior audio gain and sound quality.

In accordance with the above objects and additional objects which will become apparent hereinafter, the present invention provides a hand-held percussive musical shaker comprising an elongated metallic tubular member defining a hollow bore therethrough and having a pair of plastic diaphragms sealed over the respective ends of the tubular member to collectively form an enclosed containment volume. The diaphragms are configured to have a design natural resonance frequency complimentary to the natural resonance frequency of the tubular member. The containment volume is loosely filled with a percussive media such as a plurality of metallic particles which travel within the tubular member and between the diaphragms so as to impact the inner cylindrical surface of the tubular member, the diaphragms and each other. In the preferred embodiment, the tubular member and diaphragms are configured to provide a containment volume having a major length of approximately four (4) inches and a minor width of such dimension that the ratio of the latter to the former resides in the neighborhood of approximately 3 to 16. The metallic particles are preferably sized on the order of approximately 0.180 inches in diameter.

DETAILED DESCRIPTION OF THE PREFERRED EMBODIMENT

Figure 1:
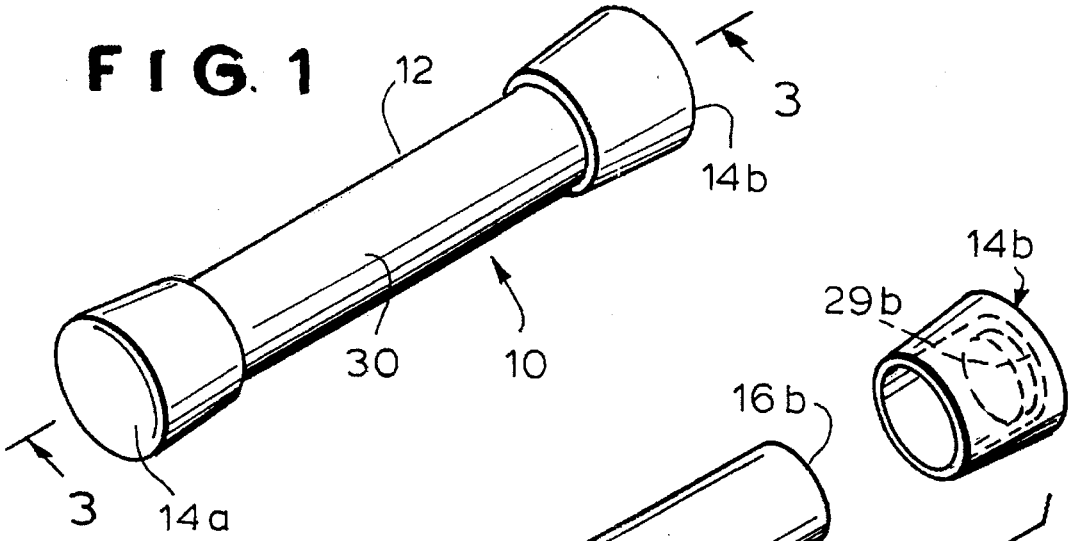
FIG. 1 is an isometric view of the shaker in accordance with the present invention.
Figure 2:
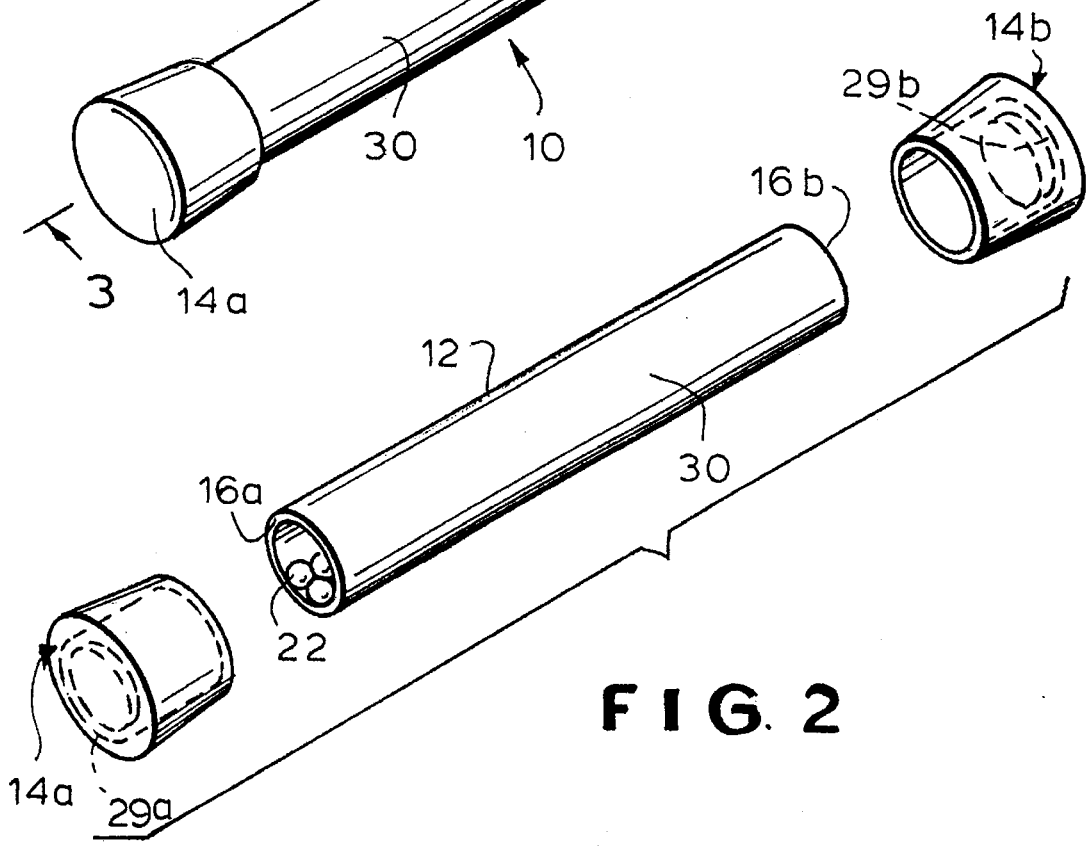
FIG. 2 is an exploded isometric view thereof.
Figure 3:
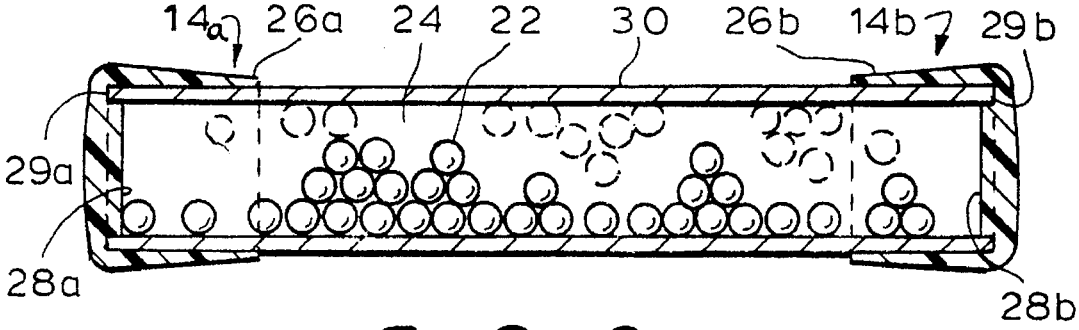
FIG. 3 is a sectional view along lines 3—3 in FIG. 1.

With reference to the several views of the drawings, there is depicted a hand-held percussive shaker generally denoted by the reference numeral 10, and principally comprised of an elongated metallic tubular member 12, a first diaphragm **14*a* sealed over a first end 16*a* of tubular member 12, and a second diaphragm 14*b* sealed over a second end 16*b* of tubular member 12**.

The tubular member 12 has a nominal wall thickness and defines a hollow bore 18 having an inner surface 20 extending therethrough. A plurality of metallic particles 22 are disposed within the containment volume 24 defined by the tubular member 12, the first diaphragm **14*a* and the second diaphragm 14*b*. The diaphragms 14*a*, 14*b* include respective tapered cylindrical portions 26*a*, 26*b* and end walls 28*a*, 28*b*. The cylindrical portions 26*a*, 26*b* are sealed over the outer cylindrical surface 30 of the tubular member 12 as shown. The end walls 28*a*, 28*b* are circumscribed by respective annular slots 29*a*, 29*b* that receive the edge of the first end 16*a* and second end 16*b* of the tubular member 12**, respectively.

Experimentation has demonstrated that a mean travel distance between opposed ends of the container (the distance between end walls 28*a*, 28*b*) approximately four (4) inches provides playability and ease of manipulation. The container width (bore 18) to the media travel distance ratio is preferably about 1 to 5 as compared to a ratio of 1 to 2.5 typical of prior art shakers. When the shaker is manipulated during play, the particles 22 form into an organized group and travel tightly against the inner surface 20 of the tubular member and impact the diaphragm walls 28*a*, 28*b*. In the preferred embodiment, the particles 22 comprise a plurality of steel balls on the order of approximately 0.180 inches in diameter. By way of contrast, most prior art shakers utilize particles made of steel slag and waste, sized in the range of from about 0.010 to 0.040 inches. The use of a larger particle size in accordance with the present invention provides a relatively higher density of percussive media per unit volume, and this transmits a higher degree of feedback to the user with respect to the position of the media within the tubular member 12. This characteristic enables multiple players to more easily match sounds when they perform simultaneously.

The present invention utilizes a novel end cap configuration to achieve a considerable acoustic gain, notwithstanding the small overall size of the instrument. In operation, the particles' 22 impact is alternately directed against each of the diaphragms 14*a*, 14*b*. The diaphragms 14*a*, 14*b* function in a manner similar to that of diaphragms in dynamic tweeters used in conventional electrodynamic loudspeakers. Each diaphragm 14*a*, 14*b* has a design resonance which can be excited by precisely timing the media impact to match this frequency. The atmospheric compression caused by the impact is gathered and focused by the diaphragms 14*a*, 14*b*, which in turn transfer a large amount of vibration to the tubular member 12.

The tubular member 12 is constructed from a high grade of aluminum stock and can be made to share a natural resonance frequency complimentary to that of the diaphragms 14*a*, 14*b* in accordance with principles well known in the art. An additional benefit provided by the diminutive sizing of, and the selection of metallic material for the tubular member 22, is the ability to modify or alter this resonance by judiciously applying finger contact to the outer cylindrical surface 30 along the longitudinal extent thereof, thereby enabling the generation of multiple tones at the player's discretion. This characteristic is best realized using metallic material for the tubular member. However, it is anticipated that thermoplastic or thermoset materials could be equally utilized within the scope of the invention. By selecting a relatively small inner diameter (typically less than three-quarter (¾) inch) for the bore of the tubular member, the particles 22 may be displaced from side to side against inner surface 20 within an extremely small period of time, and has unexpectedly demonstrated the production of viable tones.

The extreme amplification achieved with this design provides many advantages. A short travel distance enables players to achieve distinct sixteenth (1/16) and thirty-second (1/32) note passages, even at allegro tempos. This small size is what makes the instrument so playable. Ergonomically, the instrument is easy to handle and the respective diaphragms 14*a*, 14*b* ensure a positive grasp, even during rapid movements with a light grip. The invention provides superior portability and adaptability. It can be readily attached to a key chain or lanyard for this purpose, or carried in a pocket or a purse. Either or both of the diaphragms 14*a*, 14*b* can have a small hole for receiving a key chain or lanyard (not shown). It may be attached easily to the top of a shoe with an elastic or rubber band to enable a user to provide a rich rhythm at the tap of a foot or while marching. The invention may be used to send international Morse code by manipulating its resonance with finger contact for the dits and dahs. Multiple code senders have been demonstrated and easily identified as a result of the extreme directional focusing ability of the claimed configuration.

Experiments for locating objects in a darkened room have been successfully performed, again because of the sonar-like directional focusing ability of the generated sounds. This characteristic may be useful for the visually impaired. The unique sound produced by the inventive shaker has a great advantage in that although it is audible among amplified instruments, it is not overly loud or overpowering in close proximity. The frequency of the produced sounds resides in an audio spectrum that is seldom filled, i.e., white noise such as that produced by a fan or the hiss of a heating radiator. Because those sounds are usually subtle and constant, and do not start and stop percussively as those produced by the invention, the overall high volume of snare drums, trumpets and cymbals do not attenuate or drown out the percussive sounds. Accordingly, the present invention provides an ideal noisemaker for sporting events and cheering sections; people in close proximity are not deafened, yet the produced sounds can be heard at large distances away from the source.

The present invention has been shown and described in what is considered to be the most practical and preferred embodiment. It is anticipated, however, that departures may be made therefrom and that obvious modifications will be implemented by persons skilled in the art.

I claim:

1. A hand-held percussive shaker comprising:

an elongated metallic tubular member having a nominal wall thickness and defining a hollow bore having a diameter and an inner surface extending therethrough, said tubular member having a design resonance natural frequency;

a first diaphragm disposed at and sealed over a first end of said tubular member, and a second diaphragm disposed at and sealed over a second end of said tubular member to collectively form an enclosed volume having an axial length wherein said diameter to said axial length of said volume is in a ratio approximately in the range of from about 0.1875 to 1, said first diaphragm and said second diaphragm each having a design resonance natural frequency; and a plurality of metallic particles loosely disposed in said volume for striking said inner surface of said tubular member and said first diaphragm and said second diaphragm to generate percussive sounds when said shaker is moved in at least one direction by a user, said first diaphragm and said second diaphragm being sized so that said design resonance natural frequency of said first diaphragm and said second diaphragm matches the frequency generated by impact between said particles and said first and second diaphragms, respectively.

* * * * *